US006273002B1

(12) United States Patent
Hachmann et al.

(10) Patent No.: US 6,273,002 B1
(45) Date of Patent: Aug. 14, 2001

(54) RAIL VEHICLE WITH A VERTICAL SUPPORT ACTUATOR

(75) Inventors: Ulrich Hachmann, Pyrbaum; Uwe Schüller, Nürnberg; Thomas Benker, Pegnitz, all of (DE)

(73) Assignee: ABB Daimler-Benz Transportation (Technology) GmbH (DE)

( * ) Notice: Subject to any disclaimer, the term of this patent is extended or adjusted under 35 U.S.C. 154(b) by 0 days.

(21) Appl. No.: 09/283,434

(22) Filed: Apr. 1, 1999

(30) Foreign Application Priority Data

Apr. 4, 1998 (DE) ..... 198 15 197

(51) Int. Cl.[7] ..... B61F 5/00

(52) U.S. Cl. ..... 105/199.1; 105/199.2; 105/199.3; 105/413

(58) Field of Search ..... 105/199.1, 199.2, 105/199.3, 453, 413

(56) References Cited

U.S. PATENT DOCUMENTS

| | | | | |
|---|---|---|---|---|
| 3,491,702 | | 1/1970 | Dean | 105/199 |
| 3,795,203 | * | 3/1974 | Sunby | 105/182 R |
| 3,868,911 | * | 3/1975 | Schultz | 105/164 |
| 4,355,583 | * | 10/1982 | Eggert, Jr. | 105/199 CB |
| 4,458,605 | * | 7/1984 | Herring, Jr. et al. | 105/197 R |
| 4,638,742 | | 1/1987 | Potel et al. | 105/199.3 |
| 4,817,536 | * | 4/1989 | Cripe et al. | 105/182.1 |
| 5,415,107 | * | 5/1995 | Tutzauer | 105/218.2 |
| 5,588,368 | * | 12/1996 | Richter et al. | 105/199.1 |
| 5,769,400 | * | 6/1998 | Holzl et al. | 264/64.16 |

FOREIGN PATENT DOCUMENTS

| | | | | |
|---|---|---|---|---|
| 1206464 | | 7/1960 | (DE) . | |
| 1605051 | | 1/1967 | (DE) . | |
| 2218089 | | 4/1972 | (DE) | B61F/5/14 |
| 2754364 | * | 7/1979 | (DE) | 105/199.1 |
| 859422 | * | 1/1961 | (GB) | 105/199.1 |
| 437639 | * | 7/1975 | (RU) | 105/199.1 |
| 302147 | * | 7/1968 | (SE) | B61F/5/24 |

* cited by examiner

*Primary Examiner*—S. Joseph Morano
*Assistant Examiner*—Frantz F. Jules
(74) *Attorney, Agent, or Firm*—Webb Ziesenheim Logsdon Orkin & Hanson, P.C.

(57) ABSTRACT

A rail vehicle equipped with a support actuator of variable vertical length mounted between a vehicle body and a running gear located underneath. In order to maintain an operational supporting device and adequate ride comfort after a failure or overload of the support actuator, an emergency spring coaxial with the support actuator is provided, which only becomes effective when the stroke of the support actuator falls short of a preset value.

5 Claims, 3 Drawing Sheets

RAIL VEHICLE WITH A VERTICAL SUPPORT ACTUATOR

BACKGROUND OF THE INVENTION

1. Field of the Invention

Figure 1:
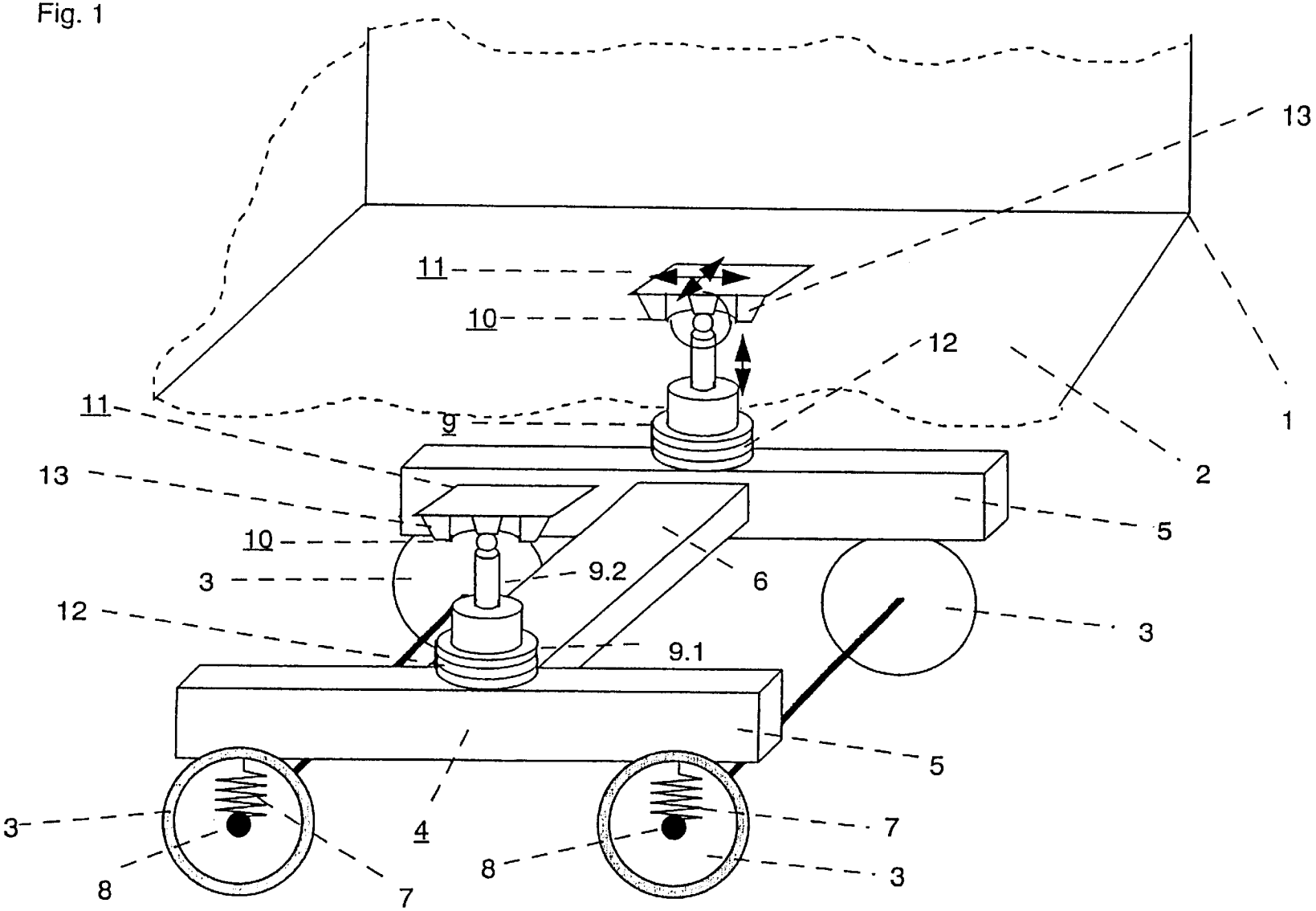

The invention relates to a rail with a support actuator of variable vertical length.

2. Brief Description of the Prior Art

The provision of spring elements arranged mechanically parallel to each other or in series to support a vehicle body on a running gear located thereunder is generally known in the context of rail vehicles. If one of the spring elements fails, the effect of the associated second spring element is maintained. In parallel arrangements, however, this involves a considerable reduction of supporting force, while a series arrangement results in a great overall length in the effective direction.

SUMMARY OF THE INVENTION

The invention is based on the problem of providing by suitable measures a rail with a support actuator of variable vertical length acting as a support spring and mounted between a vehicle body and the frame of a running gear located thereunder wherein one spring element only is effective in the usual operating conditions while maintaining a compact construction.

In constructing a rail vehicle according to the invention, the emergency spring, which is parallel in action to the support actuator in operative use, is loaded only when the support actuator at least largely loses its resilient supporting function. Only then does the stop connected to the end of the support actuator, which is adjustable relative to the emergency spring, come into contact with the adjacent end face of the emergency spring. In the usual operating conditions, the action of the support actuator is therefore not influenced in any way. If, on the other hand, the support actuator fails, the emergency spring absorbs the full load of the vehicle body, which merely drops to a lower level. The emergency spring can thus be matched to the actual body load by mechanical prestressing and limiting its stroke, thus ensuring the clearance between emergency spring and stop which is required for the normal working stroke. The actuator is in particular a hydropneumatically controlled cylinder with corresponding resilience, the force or extension to be applied being controlled in dependence on operating conditions. The cylinder housing of the actuator is preferably rigidly fixed to the running gear frame, on which one end of the emergency spring is seated as well. The stop associated with the piston rod of the actuator can be attached directly to the piston rod. Preferably, however, it is connected to the free end of the piston rod by way of a flexible joint designed as a ball joint. In this way, the stop can be firmly attached to a plate of a sliding adapter, the counter-plate of which is firmly attached to the floor of the vehicle body while being freely adjustable in one plane relative thereto. The sliding adapter may in particular be designed as a ball table. It is only adjustable parallel to the plane of the floor of the vehicle body.

The emergency spring is preferably cylindrical in design and co-axial with the cylinder housing. The stop, too, is cylindrical and matched in diameter, so that it comes to rest without tilting on the adjacent end face of the emergency spring during any failure of the actuator and is capable of compressing the emergency spring while clearing the external surface of the cylinder housing.

To limit the stroke of the mechanically prestressed emergency spring, a limiting stop consisting of several parts, if required, is provided, which extends in front of the end of the emergency spring facing the stop, while its other end is attached to the running gear frame. In this arrangement, lateral buckling is prevented by the fact that the emergency spring is guided both by the cylinder housing of the support actuator and by those parts of the supporting stop which are located in the outer area of the emergency spring.

Figure 2:
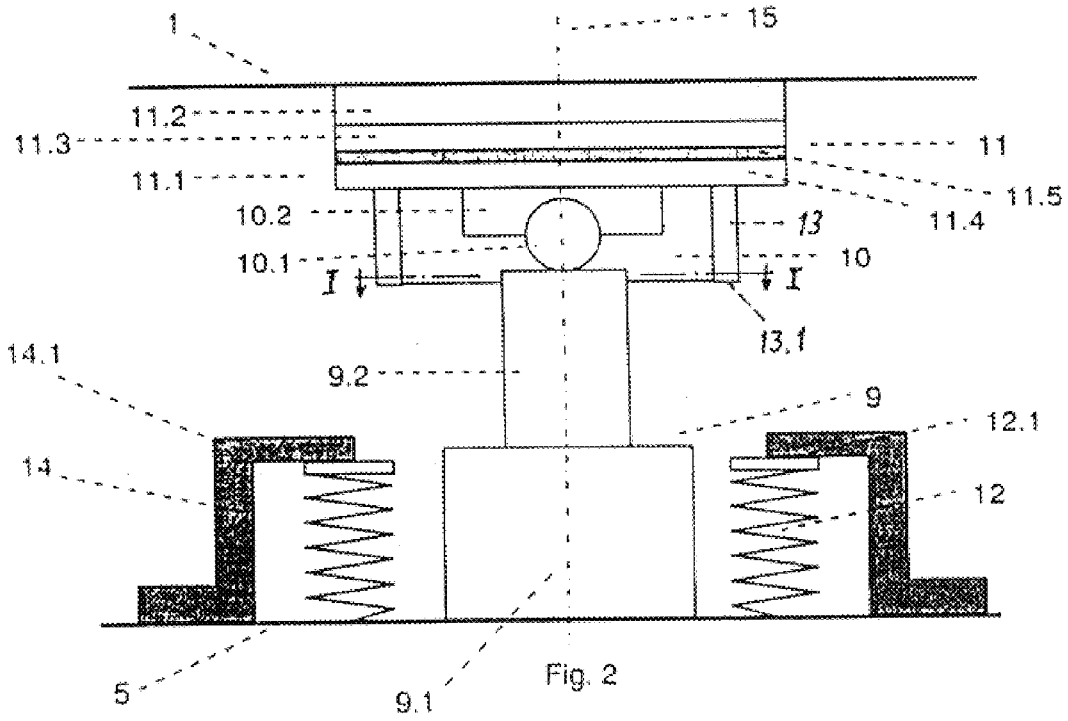
Figure 3:
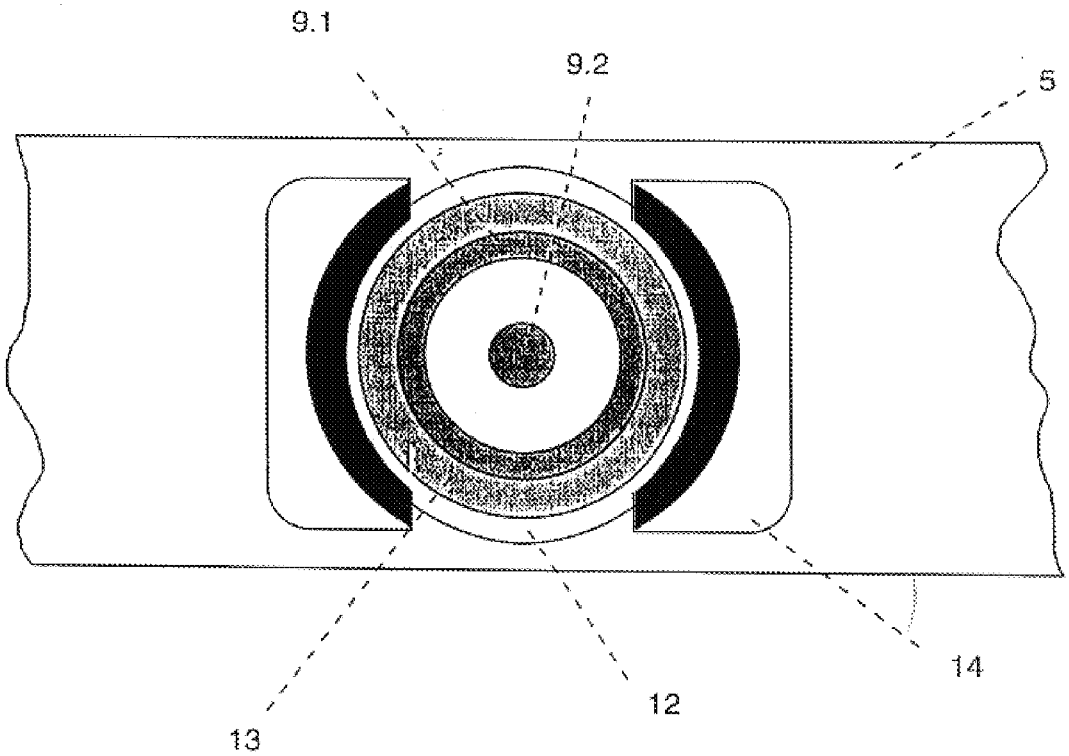

The invention is described in detail below with reference to some sketches of an embodiment, of which FIG. 1 is a perspective diagrammatic sketch of a running gear with equipment to connect it to a superimposed vehicle body;

FIG. 2 is a side view of connecting equipment with associated emergency spring; and FIG. 3 is a section along line I—I in FIG. 2.

DETAILED DESCRIPTION OF THE PREFERRED EMBODIMENT

The body 1 of a vehicle, in particular a rail vehicle, under the floor panel 2 of which a running gear is located, is indicated diagrammatically. The running gear consists of at least one axle or two wheels 3, in the illustrated embodiment two parallel axles or four wheels 3. The wheels 3 are designed to run on rails. A frame 4 comprising longitudinal members 8 extending in the direction of travel of the running gear and linked to each other by at least one crossmember 6 is supported on wheel bearing elements 8 of the wheels 3 by means of primary springs 7, thus providing a stable coupling arrangement for the wheels 3. Approximately midway between two wheels arranged in tandem in the direction of travel, each longitudinal member 5 supports connecting equipment 9, 10, 11 at rights angles to the plane formed by these longitudinal members 5, whereby the vehicle body 1 with its floor panel 2 is supported on the running gear.

The connecting equipment comprises an actuator 9, a flexible joint 10 tiltable in any direction and a sliding. All these parts are arranged mechanically in series in the effective direction of the actuator 9. The actuators 9, which may in particular be designed as hydraulic cylinders, comprise two control elements 9.1 and 9.2 capable of linear axial adjustment relative to each other only. The flexible joints 10 may be designed as universal or ball joints, rubber-elastic joints or else as spring bars for swivel movements with limited amplitude in all directions in one plane. The sliding joint 11 only has translational degrees of freedom in one plane lying parallel to the floor panel 2 of the vehicle body 1. The directional travel of this sliding joint in one plane is limited to preset values. The allocation of the individual elements 9, 10, 11 of the connecting equipment has the result that only the actuator is capable of compensating for spacing differences between bogie 4 and vehicle body 1, that the flexible joint 10 is capable only of compensating for tilting movements in a nondirectional way and that the sliding joint 11 is capable only of compensating for movements at rights angles to the direction of adjustment or the axis 15 of the actuator 9. Provided that the two end elements are fixed to the running gear 4 on the one hand and to the vehicle body 1 on the other hand, the sequence in which the elements 9, 10, 11 are assembled does not affect the principle.

In the illustrated embodiment, the cylinder housing 9.1 of, for instance, hydraulic actuators 9 with vertical axes 15 are rigidly mounted on the longitudinal members 5. The other control element 9.2 of the actuator 9 is a pushrod of the cylinder piston, which is guided in the control element 9.1 for linear movement along the axis 15 only, the free end of the control element 9.2 being rigidly connected to the first swivel element 10.1 of the flexible joint 10, while the second swivel element 10.2 is rigidly connected to the primary sliding element 11.1 of the sliding joint 11. The flexible joint 10 designed as a ball joint permits only tilting movements between the planes formed by the longitudinal members 5 and the floor panel 2. To compensate for lateral movements between the vehicle components 1, 3, 4 or for the lateral displacement resulting from the twist of the two planes, the sliding joint 11 is provided, its primary sliding element 11.1 being fixed to the second swivel element 10.2 of the flexible joint 10, while the secondary sliding element 11.2 is fixed to the floor panel 2 of the vehicle body 1.

In this type of construction, the actuator 9 can replace spring elements acting as secondary suspension. For this purpose, it is in particular designed as a hydropneumatically operated cylinder and does therefore not only compensate for variations in the vertical distance between vehicle body and bogie frame, but it can also offer the elastic characteristics of helical springs, air springs or the like. The spring characteristics can be controlled in accordance with requirements. The coupling between. vehicle body and bogie for the support of axial and transverse forces may be of a conventional nature, for instance by means of link, pivot or lemniscate coupling elements or by elastic puffer or spring elements.

The connecting equipment 9, 10, 11 can, of course, alternatively be cambered between vehicle body 1 and running gear 4.

In order to operate a rail vehicle of this design with adequate comfort and safety following a failure of the support actuator 9, a passive emergency spring 12 coaxial with the support actuator 9 is provided. In the same way as the cylinder housing 9.1 of the support actuator 9, the axial end of the emergency spring 12 is seated on a longitudinal member 5 of the running gear 4. The opposite end 12.1 of the emergency spring 12, which faces the vehicle body 1, is arranged with axial spacing opposite a ring stop 13, which is likewise coaxial with the support actuator 9, its ring end face 13.1 having the same diameter as the emergency spring 12. The other end of the ring stop 13 is rigidly connected to the primary sliding element 11.1 of the sliding joint 11. As the primary sliding element 11.1 does not move laterally relative to the longitudinal axis 15 of the support actuator, its axial coordination with the emergency spring 12 is always maintained.

The axial free distance between the upper end 12.1 of the emergency spring 12 and the adjacent free ring end face of the annular supporting stop 13 is calculated to ensure that there is no contact between the supporting stop 13 and the emergency spring 12 during the stroke of the support actuator in the usual operating conditions. Very high loadings or the failure of the support actuator, however, cause the supporting stop 13 to drop axially onto the free end of the emergency spring 12 under the guidance of the support actuator 9. The emergency spring is designed to absorb the static and dynamic forces generated between running gear 4 and vehicle body 1 during normal operation, the stroke of the actuator 9 not being reduced to its lower limit under these conditions. When the vehicle body 1 is only lowered, the suspension behaviour of the arrangement is maintained. The internal diameter of the annular supporting stop 13 is greater than the external diameter of the cylinder housing 9.1, in order to make optimum use of the available suspension travel by overtravel. The supporting stop, which is open towards the emergency spring 12, can thus axially overlap the barrel of the cylinder 9.

In order to keep its axial dimension to a minimum, the emergency spring 12 is mechanically prestressed in the axial direction. To achieve this, its free end 12.1 facing the supporting stop 13 rests against at least one limiting stop 14 fixed to the running gear frame 5. The stop 14 consists of two parts and is located on half shells 14.1 fixed diametrically to the longitudinal member 5 in the area of the external surface of the emergency spring 12. In the form of ring surface sections, the stops 14 horizontally cover the outer edge of the free upper end 12.1 of the emergency spring 12 in the radial direction. In the circumferential direction, there is a free area between the two limiting stops 14, in which the supporting stop 13 can be seated on diametrically opposite sections over the whole radial dimension of the emergency spring 12. The clearance between the mounting point of the emergency spring 12 on the running gear frame 4 and the limiting stop 14 is smaller than the axial dimension of the relaxed emergency spring. By selecting the distance between longitudinal member 5 and limiting stop 14, the prestressing of the emergency spring 12 can be matched to the prevailing operating conditions.

What is claimed is:

1. A rail vehicle with a support actuator of variable vertical lengths acting as a support spring and mounted between a vehicle body and the frame of a running gear located thereunder, comprising an emergency spring coaxially arranged around the support actuator and mechanically prestressed in the axial direction, wherein one end of the emergency spring and one end of the support actuator are mounted on the running gear frame, a supporting stop is fixed to the support actuator in the area of the other end of the support actuator, the supporting stop is clear of the adjacent end of the emergency spring while the support actuator is at least largely extended during operation, and the end of the emergency spring adjacent to the stop rests against at least one limiting stop fixed to the running gear frame.

2. A rail vehicle with a support actuator of variable vertical lengths acting as a support spring and mounted between a vehicle body and the frame of a running gear located thereunder, comprising an emergency spring coaxially arranged around the support actuator, wherein one end of the emergency spring and one end of the support actuator are mounted on the running gear frame, a supporting stop is fixed to the support actuator in the area of the other end of the support actuator, the supporting stop is clear of the adjacent end of the emergency spring while the support actuator is at least largely extended during operation, and the supporting stop is linked to the actuator by a flexible joint, while being rigidly mounted on a plate of a sliding joint and another plate, which is capable of relative parallel movement, rigidly mounted on the underside of the vehicle body.

3. The rail vehicle according to claim 2, wherein the flexible joint is a ball joint.

4. A rail vehicle with a support actuator of variable vertical lengths acting as a support spring and mounted between a vehicle body and the frame of a running gear located thereunder, comprising an emergency spring coaxially arranged around the support actuator and mechanically compressed in the axial direction, wherein one end of the emergency spring and one end of the support actuator are mounted on the running gear frame, a supporting stop is fixed to the support actuator in the area of the other end of the support actuator, the supporting stop is clear of the adjacent end of the emergency spring while the support actuator is at least largely extended during operation, the end of the emergency spring adjacent to the stop rests against at least one limiting stop fixed to the running gear frame, and the actuator is a hydropneumatically controlled cylinder having a cylinder housing rigidly mounted on the running gear frame, wherein the stop is mounted on the free end of a piston rod of the cylinder by way of a ball joint and the emergency spring is arranged coaxially around the cylinder housing.

5. The rail vehicle according to claim 4, wherein the supporting stop has a cylindrical shoulder coaxial with the piston rod, the internal diameter of which is larger than the external diameter of the cylinder housing, is open towards the emergency spring, and forms an axial extension of the adjacent end of the emergency spring.

* * * * *

UNITED STATES PATENT AND TRADEMARK OFFICE

CERTIFICATE OF CORRECTION

PATENT NO. : 6,273,002 B1
DATED : August 14, 2001
INVENTOR(S) : Ulrich Hachmann et al.

It is certified that error appears in the above-identified patent and that said Letters Patent is hereby corrected as shown below:

Title page,
Item [56] References Cited, U.S. PATENT DOCUMENTS, insert
-- 859,422 7/1907 Allen.....105/199.1 --
Item [56] References Cited, FOREIGN PATENT DOCUMENTS, delete
"859422 * 1/1961 (GB).....105/199.1"

Column 1,
Line 6, "relates to a rail" should read -- relates to a rail vehicle --.
Line 21, after "a rail" insert -- vehicle --.

Column 2,
Lines 8-9, delete "The invention is described in detail below with reference to some sketches of an embodiment, of which" and insert the heading -- BRIEF DESCRIPTION OF THE DRAWINGS --.

Signed and Sealed this

Twenty-first Day of May, 2002

*Attest:*

*Attesting Officer*

JAMES E. ROGAN
*Director of the United States Patent and Trademark Office*